US006320129B1

(12) United States Patent
Chou et al.

(10) Patent No.: US 6,320,129 B1
(45) Date of Patent: Nov. 20, 2001

(54) METHOD FOR MAKING ELECTRODE OF POLYMER COMPOSITE

(75) Inventors: Shu-Chin Chou; Kun-Huang Chang; Chen-Ron Lin, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/399,827

(22) Filed: Sep. 21, 1999

(51) Int. Cl.[7] ..... H01B 3/14

(52) U.S. Cl. ..... 174/68.1; 205/109

(58) Field of Search ..... 174/68.1; 219/553; 205/109

(56) References Cited

U.S. PATENT DOCUMENTS

| | | | | |
|---|---|---|---|---|
| 3,591,468 | * | 7/1971 | Nishio et al. | 205/109 |
| 3,676,308 | * | 7/1972 | Brown | 205/109 |
| 3,945,893 | * | 3/1976 | Ishimori et al. | 205/109 |
| 4,689,475 | * | 8/1987 | Kleiner et al. | 219/553 |
| 4,904,545 | * | 2/1990 | Sagiyama et al. | 428/659 |
| 5,865,976 | * | 2/1999 | Takeuchi et al. | 205/109 |
| 5,928,547 | * | 7/1999 | Shea et al. | 219/505 |

* cited by examiner

*Primary Examiner*—Rajnikant D. Patel

(57) ABSTRACT

This invention provides a method for making an electrode film for a composite polymer material. A composite plating method is used to form a conductive plate film with microrough surface of 0.01 to 100 microns which will be adhered to a composite polymer material, enhances the adhering performance and reduces the interface electrical resistance.

29 Claims, 3 Drawing Sheets

METHOD FOR MAKING ELECTRODE OF POLYMER COMPOSITE

BACKGROUND OF THE INVENTION

1. Field of Invention

The present invention generally relates to a method for making a conductive electrode for a composite polymer material, and more particularly, relates to a method for making a metallic electrode on which a microrough surface is formed by a composite plating process.

2. Related Art

For the demands of electrical conductivity, abrasion resistance and wiring with other metal elements, a conductive polymer composite is generally coated with a metallic film so as to be made into a reactive element, such as a capacitor or a resistor.

Due to the different coefficients of expansion for the metallic electrode and the conductive polymer, poor contact between the two generally occur. A first problem is that when the polymer composites are applied to resistors or components of positive temperature coefficient, the poor contact between the metallic electrode and the conductive polymer becomes more critical since they encounter cyclic or non-cyclic temperature variances. The second problem concerns with the resistance of interface between the metallic electrode and the conductive polymer. Since the conductive polymer is made from conductive grains and insulating polymer material, during the adhering process of the metallic electrode to the conductive polymer, the insulating polymer material may flow into the interface of the conductive grains and the metallic electrode, causes higher resistance and decreases the performance of the finished polymer composite.

FIGS. 1*a* to 1*c* are sectional views showing the interface of the conductive polymer 10 and the metallic electrode 12 in three stages of enlargement. The views clearly show that the contact surfaces of the polymer 10 and the metallic electrode 12 are smooth.

To solve the problems of poor contact and higher interface resistance, U.S. Pat. Nos. 4,689,475 and 4,800,253 disclose compositions of metallic electrode and conductive polymer element in which the metallic electrode has a microrough surface, for example, having irregularities which protrude from the surface with a height of 0.1 to 100 microns, to improve its adhesion to the conductive polymer. As shown in FIGS. 2*a* to 2*c,* the three stage enlarged sectional views of the interface of the conductive polymer 10 and the metallic electrode 14, the microrough surface of the metallic electrode 14 will improve the adhesive strength of the electrode 14 to the polymer 10, and enhance the conductivity of the electrode 14 and the conductive polymer 10 by the larger contact area of the microrough surface. But, the processes for forming the microrough surfaces are not disclosed in the two patents, and the roughness of the electrode 14 is not enough. In the U.S. Pat. No. 4,689,475, the metallic electrode 14 and the polymer 10 contact only by impacting. The U.S. Pat. No. 4,800,253, which is a continuation-in-part of U.S. Pat. No. 4,689,475, makes the electrode in direct physical contact with the conductive polymer element and having two-stage protrusions which may enhance the connection of the electrode and the polymer. But, during impacting, there is no excess cavity for the polymer composite to flow, as a result, the insulating polymer material flowing into the interface of the conductive grains and the metallic electrode still decreases the conductivity of the electrode and the polymer.

SUMMARY OF THE INVENTION

It is therefore an objective of the present invention to provide a conductive film, having microrough surface made by a composite plating method, to be applicable as an electrode of a polymer composite, so that the conductive polymer composite performs higher adhesive strength between the electrode and the polymer, and lower interface resistance therebetween.

In order to achieve the foregoing objective, the present invention provides a method for making a conductive polymer composite. The method includes the following steps: providing a conductive polymer base material; utilizing a composite plating method to form an electrode having microrough surface of layer, measured 0.1 to 100 microns, on a surface of a base material; and finally pressing the electrode onto the conductive polymer base material. The microrough electrode made by composite plating method enhances the adhering strength of the electrode to the polymer composite, and provides suitable cavities for the flow of polymer so as to prevent the insulating polymer from filling into the clearance between the electrode and the conductive grains, and ensures the lower interface resistance.

Another objective of the present invention is to provide a process for fabricating composite plating films which have microrough surfaces. The process includes the following steps: preparing a plating tank containing a metal plating solution and insoluble particles dispersed in the metal plating solution; placing a polymer base material on the cathode while placing a metal on the anode of a power supply for plating and forming a microrough surface of 0.1 to 100 microns roughness on the base material.

A further objective of the present invention is to provide an electronic element including a conductive polymer base material and a conductive electrode having microrough surface of 0.1 to 100 microns in roughness. The microrough surface of the electrode can firmly adhere to the composite polymer.

BRIEF DESCRIPTION OF THE DRAWINGS

The present invention, together with the objects and advantages thereof, may best be understood by reference to the following description of the preferred embodiments taken in conjunction with the accompanying drawings in which.

DETAILED DESCRIPTION OF PREFERRED EMBODIMENTS

Figure 1A:
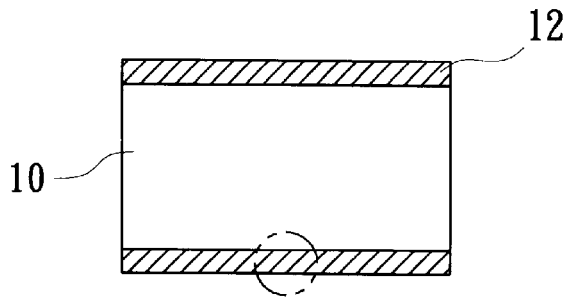
FIG. 1a(Prior Art)
FIGS. 1*a* to 1*c* are sectional views showing the interface of a prior art conductive polymer element and a metallic electrode in three stages of enlargement.
Figure 1B:
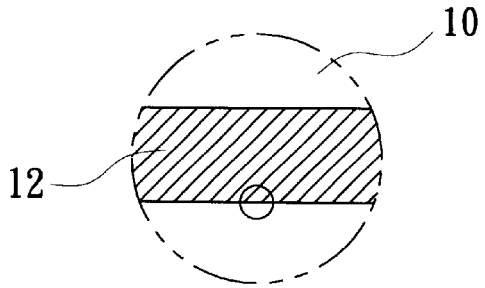
FIG. 1b(Prior Art)
Figure 1C:
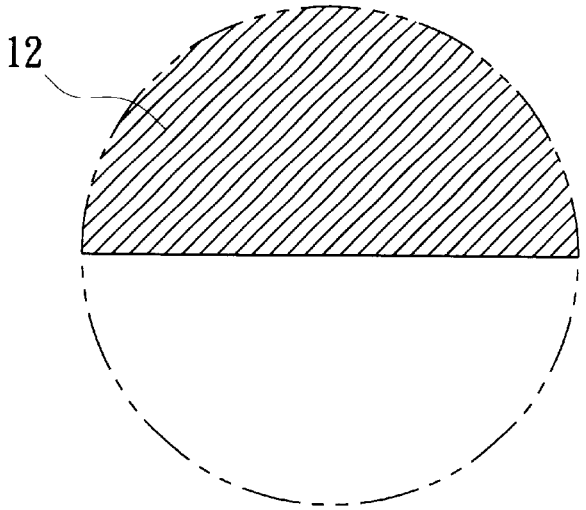
FIG. 1c(Prior Art)
Figure 2A:
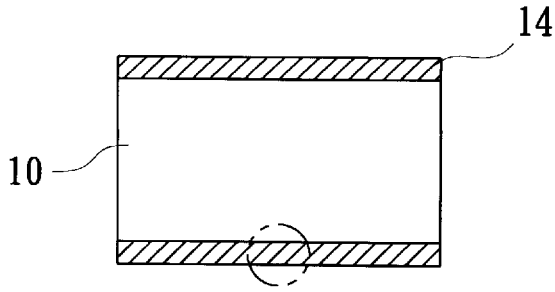
FIG. 2a(Prior Art)
FIGS. 2*a* to 2*c* are sectional views showing the interface of another prior art conductive polymer element and a metallic electrode in three stages of enlargement.
Figure 2B:
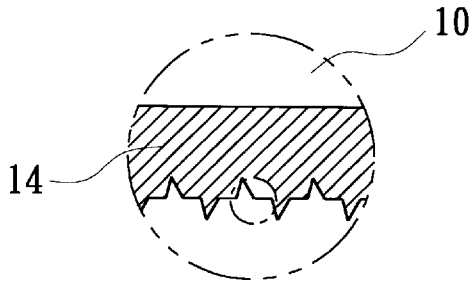
FIG. 2b(Prior Art)
Figure 2C:
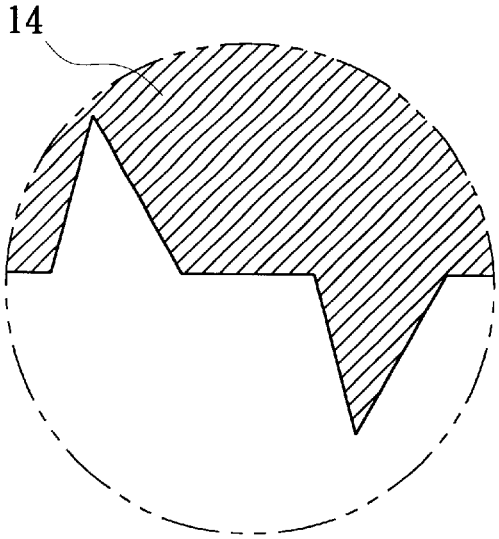
FIG. 2c(Prior Art)

Composite plating is presently used to make surfaces finishing for the functions of abrasion resistance, hardness enhancement or heat-resistance reducing. The insoluble particles added in the plating solution are chosen from one of silicon carbide (SiC), aluminum oxide ($Al_2O_3$), tungsten carbide (WC), chromium oxide ($Cr_2O_3$), diamond and graphite, as disclosed in U.S. Pat. Nos. 5,651,872 and 5,282,536. The present invention utilizes the composite plating method by selecting suitable insoluble particles and the particle size thereof to form a suitable microrough surface on the metallic electrode and solve the problems of adhering strength and interface electrical resistance when the electrode is adhered onto the conductive polymer.

The process for fabricating a composite plating film by the composite plating method is described below.

1) preparing a base material, such as electrical conductive glass, stainless steel, nickel foil or copper foil, as a receiver for the plating film to form on during the proceeding plating process;
2) removing oil or impurities from the surfaces of the base material;
3) plating by first preparing the composite plating solution of metal plating solution and insoluble particles. The metal plating solution is chosen from nickel plating solution, copper plating solution, nickel alloy solution or copper alloy solution. The insoluble particles are chosen from at least one of carbon black, graphite, nickel powder, nickel-plated graphite powder, copper powder, copper-plated graphite powder or others. Then, placing an electrode metal on the anode of the plating tank, placing the base material on the cathode, and applying electric current to conduct plating;
4) cleaning the conductive film, which is disposed on the base material after plating, to clean up the impurities on the film;
5) peeling off the conductive film from the base material. But, if the base material, e.g., copper foil, is capable of being used as an electrode, the base material with the film can be directly used; and
6) drying the conductive film or also the base material for further process of making into electrode.

Besides, for dispersing the insoluble particles evenly in the plating solution and ensuring uniform roughness of the plate film, the composite plating solution has to be processed by the following steps:

a) gradually adding the insoluble particles into the plating solution;
b) separating the insoluble particles by ultrasonic wave; and
c) circulating and stirring the composite plating solution.

In the aforesaid composite plating process, the materials and process conditions should be suitably accommodated in order to obtain the desired roughness of the plate film. For example, if nickel plating solution is taken, the concentration of the nickel solution is 10 to 200 g/l, and preferably 40 to 100 g/l; if copper plating solution is taken, the concentration of the copper solution is same of 10 to 200 g/l, and preferably 40 to 100 g/l. The concentration of the insoluble particles is 1 to 30 g/l, and the average size thereof is 0.01 to 100 microns. The current density of plating is controlled within 0.5 to 10 ASD, and preferably within 2 to 6 ASD. The temperature is controlled within room temperature (25 degree centigrade) to 60 degree centigrade, and preferably within 35 to 55 degree centigrade.

Figure 3A:
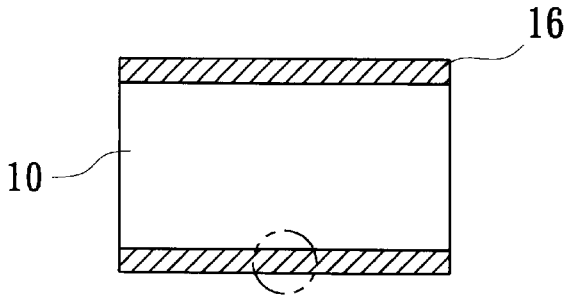
FIGS. 3*a* to 3*c* are sectional views showing the interface of a conductive polymer element and a metallic electrode according to the present invention in three stages of enlargement.
Figure 3B:
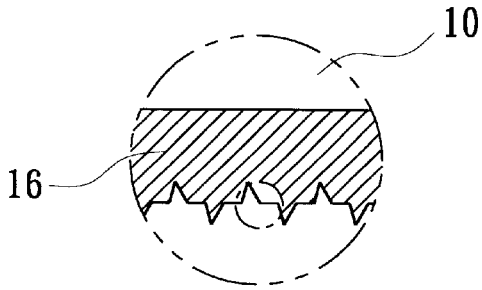
Figure 3C:
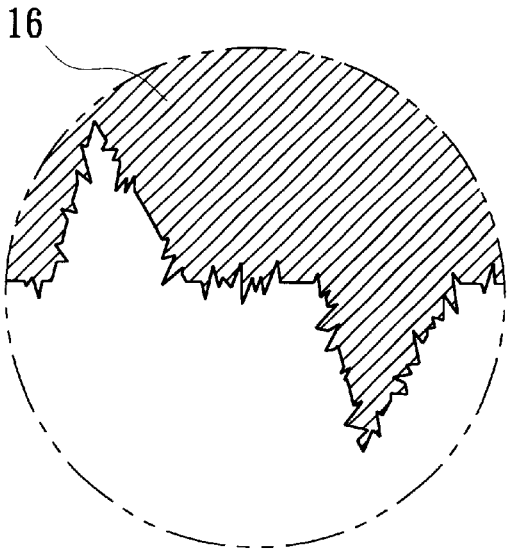

By the aforesaid plating process, at least a microrough surface of 0.01 to 100 microns can be formed on the plate film. As shown in FIGS. 3*a to* 3*c,* two electrodes 16 made from composite plate films are placed on both sides of a conductive polymer element 10. The electrodes 16 and the conductive polymer 10 are then hot-pressed to adhere. The material of the electrodes 16 are chosen from alloys of nickel, nickel-cobalt, nickel-ferrum, nickel-manganese, nickel-zinc, nickel-phosphorus, nickel-boron, and nickel-palladium, etc., in which the volume percentage of nickel is more than 70%; or the material of the electrodes 16 can be chosen from alloys of copper, copper-zinc, and copper-nickel, etc., in which the volume percentage of copper is more than 70% also.

As described above, the surface of the electrode made from composite plating can be formed with suitable roughness, which not only enhances the adhering strength of the electrode to the polymer composite; but also provides suitable cavity for the insulating polymer to flow and prevents the insulating polymer to flow into the clearance of conductive grains and the electrode so as to ensure the lower resistance.

The following examples are composite polymer products made from different raw materials and verified through thermo cycling tests to prove their quality.

The conditions of thermo cycling test are: exposing the finished electrode composite polymer under circulating hot air of 100 degree centigrade for 30 minutes, then naturally cooling it in the room air for 15 minutes; and repeating the procedures for at least 100 cycles. The test piece is viewed by eyes if there is any separation or deformation between the electrode and the polymer.

The test pieces are made as follows.

1) mixing and extruding conductive composite polymer grains by a bi-screw extruder made by WP Co. (ZSK 25). The compositions of high density polyethylene (HDPE) and carbon black are as follows:

| Composition | Commercial Name | Weight Percentage | Manufacturer |
|---|---|---|---|
| HDPE | LH-606 | 70% | Taiwan Polymer |
| Carbon black | XC-71 | 30% | Cabot, US |

2) heat-molding the polymer grains under 160 degree centigrade to form circular test pieces of 65.0 mm diameter and 1.0 mm thickness;
3) cutting conductive electrode films made by aforementioned composite plating method into foils of 65.0 mm diameter; placing two foils on each polymer test piece; heat-pressing them under 160 degree centigrade to form into a piece, and cooling it for test use.

The composite plating is conducted as follows:

First Embodiment

Plating solution: $[Ni_2^+]$, 60 g/l;
Boric acid: 20 g/l;
pH: 4.5;
Temperature: 50 degree centigrade;
Current density: 5 ASD;
Plating time: 10 minutes; and
Insoluble particles: carbon black (XC-72, Carbot, US) or graphite with grain size less than 1 micron, 4 g/l.

The test result is no separation or deformation.

Second Embodiment

Plating solution: $[Ni_2^+]$, 20 g/l, $[Co_2^+]$, 4 g/l;
Boric acid: 20 g/l;
pH: 4.5;
Temperature: 45 degree centigrade;
Current density: 5 ASD;
Plating time: 10 minutes; and
Insoluble particles: carbon black (Raven, Columbian Chemical, US) or nickel powder with grain size of 10 to 20 micron, 6 g/l.

The test result is no separation or deformation.

Third Embodiment

Plating solution: [$Cu_2^+$], 30 g/l;

Amine sulphate: 25 g/l;

pH: 4.5;

Temperature: 45 degree centigrade;

Current density: 7 ASD;

Plating time: 5 minutes; and

Insoluble particles: carbon black (XC-72, Carbot, US) or graphite with grain size less than 1 micron, 4 g/l.

The test result is no separation or deformation.

Although the present invention has been described in detail with reference to its presently preferred embodiments, it should be understood by those skilled in the art that various modification and variations can be made without departing from the spirit or scope of the present invention. Therefore, the present embodiment is to be considered as illustrative and not restrictive, and the invention is not to be limited to the details given herein, but may be modified within the scope of the appended claims.

What is claimed is:

1. A method for making a conductive polymer composite having an electrode, comprising the steps of:

providing a conductive polymer element;

utilizing a composite plating method to form an electrode film having a microrough surface on a conductive base; and pressing the electrode onto the conductive polymer element;

wherein the composite plating method comprises the steps of:

preparing a composite plating solution containing a metal plating solution and insoluble particles;

placing a base material on a cathode of a plating apparatus;

placing a conductive base on an anode of a plating apparatus; and conducting plating to form the microrough surface of the electrode;

further wherein the composite plating solution is prepared using the following steps:

gradually adding the insoluble particles into the plating solution;

applying ultrasonic wave to keep the insoluble particles segregated from each other;

circulating and stirring the composite plating solution.

2. A method for making a conductive polymer composite according to claim 1, wherein the roughness of the microrough surface is about 0.1 to 100 microns.

3. A method for making a conductive polymer composite according to claim 1, wherein the base material is chosen from one of electrical conductive glass, stainless steel, nickel foil, copper foil and the like.

4. A method for making a conductive polymer composite according to claim 1, wherein the metal plating solution is chosen from one of nickel plating solution, copper plating solution, nickel alloy solution, copper alloy solution and the like.

5. A method for making a conductive polymer composite according to claim 1, wherein the insoluble particles are chosen from at least one of carbon black, graphite, nickel powder, nickel-plated graphite powder, copper powder, copper-plated graphite powder and the like.

6. A method for making a conductive polymer composite according to claim 1, wherein the concentration of the metal in the metal plating solution is 10 to 200 g/l, the concentration of the insoluble particles is 1 to 30 g/l, and the average size thereof is 0.01 to 100 microns.

7. A method for making a conductive polymer composite according to claim 6, wherein the concentration of the metal in the metal plating solution is preferably 40 to 100 g/l.

8. A method for making a conductive polymer composite according to claim 6, wherein the concentration of the insoluble particles is preferably 4 to 10 g/l.

9. A method for making a conductive polymer composite according to claim 1, wherein the current density of plating is controlled within 0.5 to 10 ASD, and under temperature of 25 to 60 degree centigrade.

10. A method for making a conductive polymer composite according to claim 9, wherein the current density of plating is preferably controlled within 2 to 6 ASD.

11. A method for making a conductive polymer composite according to claim 9, wherein the temperature is preferably 35 to 55 degree centigrade.

12. A method for making a conductive polymer composite according to claim 1, wherein the material of the electrode is chosen from one of the alloys of nickel, nickel-cobalt, nickel-iron, nickel-manganese, nickel-zinc, nickel-phosphorus, nickel-boron, nickel-palladium, and the like.

13. A method for making a conductive polymer composite according to claim 12, wherein the volume percentage of the nickel in the material of the electrode is at least 70%.

14. A method for making a conductive polymer composite according to claim 1, wherein the material of the electrode is chosen from one of the alloys of copper, copper-zinc, copper-nickel, and the like.

15. A method for making a conductive polymer composite according to claim 14, wherein the volume percentage of the copper in the material of the electrode is at least 70%.

16. A method for making a conductive plating film having a microrough surface, comprising the steps of:

preparing a plating tank having a composite plating solution containing a metal plating solution and insoluble particles;

placing a base material on a cathode of a plating apparatus;

placing a conductive base on an anode of a plating apparatus; and conducting plating to form the microrough surface of the electrode on the base material said mircorough having a surface roughness ranging from 0.01 to 100 microns;

wherein the composite plating solution is prepared using the following steps:

gradually adding the insoluble particles into the plating solution;

applying ultrasonic wave to keep the insoluble particles segregated from each other;

circulating and stirring the composite plating solution.

17. A method for making a composite plating film having a microrough surface according to claim 16, wherein the base material is chosen from one of electrical conductive glass, stainless steel, nickel foil, copper foil and the like.

18. A method for making a composite plating film having a microrough surface according to claim 16, wherein the metal plating solution is chosen from one of nickel plating solution, copper plating solution, nickel alloy solution, copper alloy solution and the like.

19. A method for making a composite plating film having a microrough surface according to claim 16, wherein the insoluble particles are chosen from at least one of carbon black, graphite, nickel powder, nickel-plated graphite powder, copper powder, copper-plated graphite powder and the like.

20. A method for making a composite plating film having a microrough surface according to claim 16, wherein the concentration of the metal in the metal plating solution is 10 to 200 g/l, the concentration of the insoluble particles is 1 to 30 g/l, and the average size thereof is 0.01 to 100 microns.

21. A method for making a composite plating film having a microrough surface according to claim 20, wherein the concentration of the metal in the metal plating solution is preferably 40 to 100 g/l.

22. A method for making a composite plating film having a microrough surface according to claim 20, wherein the concentration of the insoluble particles is preferably 4 to 10 g/l.

23. A method for making a composite plating film having a microrough surface according to claim 16, wherein the current density of plating is controlled within 0.5 to 10 ASD, and under temperature of room air to 60 degree centigrade.

24. A method for making a composite plating film having a microrough surface according to claim 23, wherein the current density of plating is preferably controlled within 2 to 6 ASD.

25. A method for making a composite plating film having a microrough surface according to claim 23, wherein the temperature is preferably 35 to 55 degree centigrade.

26. A method for making a composite plating film having a microrough surface according to claim 16, wherein the material of the electrode is chosen from one of the alloys of nickel, nickel-cobalt, nickel-iron, nickel-manganese, nickel-zinc, nickel-phosphorus, nickel-boron, nickel-palladium, and the like.

27. A method for making a composite plating film having a microrough surface according to claim 26, wherein the volume percentage of the nickel in the material of the electrode is at least 70%.

28. A method for making a composite plating film having a microrough surface according to claim 16, wherein the material of the electrode is chosen from one of the alloys of copper, copper-zinc, copper-nickel, and the like.

29. A method for making a composite plating film having a microrough surface according to claim 28, wherein the volume percentage of the copper in the material of the electrode is at least 70%.

* * * * *